US007604311B2

(12) United States Patent
Kobayashi et al.

(10) Patent No.: US 7,604,311 B2
(45) Date of Patent: Oct. 20, 2009

(54) DROPLET EJECTION DEVICE AND DROPLET EJECTION METHOD

(75) Inventors: Shinya Kobayashi, Ibaraki (JP); Hitoshi Kida, Ibaraki (JP); Takahiro Yamada, Ibaraki (JP)

(73) Assignee: Ricoh Printing Systems, Ltd., Tokyo (JP)

( * ) Notice: Subject to any disclaimer, the term of this patent is extended or adjusted under 35 U.S.C. 154(b) by 301 days.

(21) Appl. No.: 11/361,541

(22) Filed: Feb. 24, 2006

(65) Prior Publication Data

US 2006/0192801 A1 Aug. 31, 2006

(30) Foreign Application Priority Data

Feb. 25, 2005 (JP) ..... 2005-051683
Feb. 20, 2006 (JP) ..... 2006-042601

(51) Int. Cl.
*B41J 29/38* (2006.01)

(52) U.S. Cl. ..... 347/9; 347/12

(58) Field of Classification Search ..... None
See application file for complete search history.

(56) References Cited

U.S. PATENT DOCUMENTS 6,003,969 A * 12/1999 Freret, Jr. ..... 347/40
6,331,052 B1 * 12/2001 Murai et al. ..... 347/68
2003/0107611 A1 * 6/2003 Kim ..... 347/12
2004/0183842 A1 * 9/2004 Kobayashi et al. ..... 347/10
2006/0087525 A1 * 4/2006 Jackson Pulver et al. ..... 347/12

FOREIGN PATENT DOCUMENTS

JP 2002-120366 4/2002
JP 2002-273890 9/2002

* cited by examiner

*Primary Examiner*—Matthew Luu
*Assistant Examiner*—Justin Seo
(74) *Attorney, Agent, or Firm*—Blakely, Sokoloff, Taylor & Zafman LLP

(57) ABSTRACT

In a droplet ejection device, a latch circuit acquires discharge data in which a resolution is set up for each resolution section in a transport direction of a recording medium, and sets data elements in each resolution section for respective ones of a plurality of nozzles. An output enable signal generating unit generates an output enable signal periodically at intervals of a different distance. A drive waveform applying unit applies a drive waveform to a common electrode line of piezoelectric elements of the nozzles in synchronization with the output enable signal, the drive waveform having a time to discharge each piezoelectric element gradually. A switching circuit turns on or off a switch based on a logical AND of the output enable signal and the discharge data and grounds an individual electrode of each piezoelectric element.

7 Claims, 12 Drawing Sheets

DROPLET EJECTION DEVICE AND DROPLET EJECTION METHOD

The present application claims priority to and incorporates herein by reference the entire contents of Japanese priority application no. 2005-051683, filed in Japan on Feb. 25, 2005, and application no. 2006-042601, filed in Japan on Feb. 20, 2006.

BACKGROUND OF THE INVENTION

1. Field of the Invention

The present invention generally relates to a droplet ejection device and a droplet ejection method, and more particularly to a droplet ejection device and a droplet ejection method for performing ejection of ink with high precision.

2. Description of the Related Art

Conventionally, a multi-nozzle ink-jet printing device having a printing head module in which a plurality of nozzles are arranged is proposed as an ink-jet printing device as a droplet ejection device which enables high-speed printing. This multi-nozzle ink-jet printing device uses a large number of nozzles, and it can perform printing at high speed with high density when recording information on a recording media, such as paper.

Generally, ink-jet printing devices can be classified into a continuation system and an on-demand system. The printing head module of the on-demand system is a droplet ejection unit in which a plurality of nozzles are arranged. For each nozzle, a drive voltage is applied to the piezoelectric element or heater element so that pressure is applied to the ink in the ink chamber having the nozzle as an opening, thereby ejecting an ink droplet from the nozzle.

The technology related to the printing head module of this type is already known. See Japanese Laid-Open Patent Application No. 2002-273890 and Japanese Laid-Open Patent Application No. 2002-120366. When compared with the continuation system, the on-demand system has a simple structure, and, in the printing head module of the on-demand system, several hundreds or thousands of nozzles can be arranged with high density.

Suppose a case in which the above-mentioned multi-nozzle ink-jet printing device is used and printing is performed to various recording media, such as recording boards or recording sheets, with which the permeability of ink differs. In is known that there is an optimum amount of ink spread per unit area for the recording media of different types, and as for the recording media of the same type there is also an optimum amount of applied ink per unit area according to the type of the recording medium.

When the ink spread is less than the optimum value, the optical density of a filled-in image falls or a thin line becomes blurred, and the quality of image deteriorates. On the other hand, when the ink spread (the amount of ink ejection) is more than the optimal value, the image runs or drying of ink delays. Or if the recording medium is paper, the ink goes through the back surface of the paper. The ink spread more than the optimum value means that an excessive amount of the ink large than the necessary amount is unnecessarily used.

Therefore, the optimum value of the ink spread must be kept by performing adjustment with high precision for every kind of the recording media.

In a case of a low-speed ink-jet printing device having a small number of nozzles, the ink spread can be adjusted with high precision by adjusting the drive voltage of the piezoelectric element or the number of minute ink droplets. However, in a case of a high-speed multi-nozzle ink-jet printing device, it is difficult to take a circuit configuration for performing highly precise fine adjustment. Also, with respect to the processing speed, it is difficult to keep up the processing with the fine adjustment.

In a case in which the adjustment of ink spread is performed with the number of droplets, if the diameter of droplet is large, a jitter will appear at the edge of the output image, and the quality of image will be degraded.

SUMMARY OF THE INVENTION

A droplet ejection device and droplet ejection method is described. In one embodiment, a droplet ejection device that includes at least one printing head module in which a plurality of nozzles are arranged, and ejects ink from the printing head module to a recording medium, comprises a latch circuit to acquire discharge data in which a resolution is set up for each of resolution units in a transport direction of the recording medium to set discharge data elements in each resolution unit for respective ones of the plurality of nozzles, an output enable signal generating unit to generate an output enable signal periodically at intervals of a distance differing from a distance of each resolution unit, a drive waveform applying unit to apply a drive waveform to a common electrode line of respective piezoelectric elements of the plurality of nozzles in synchronization with the output enable signal, the drive waveform having a time to discharge each piezoelectric element gradually, and a switching circuit to turn on or off a switch based on results of ANDing the output enable signal and the discharge data outputted from the latch circuit to cause an individual electrode of each of the piezoelectric elements of the plurality of nozzles to be grounded.

BRIEF DESCRIPTION OF THE DRAWINGS

Other embodiments, features and advantages of the present invention will be apparent from the following detailed description when reading in conjunction with the accompanying drawings.

DETAILED DESCRIPTION OF PREFERRED EMBODIMENTS

Figure 1:
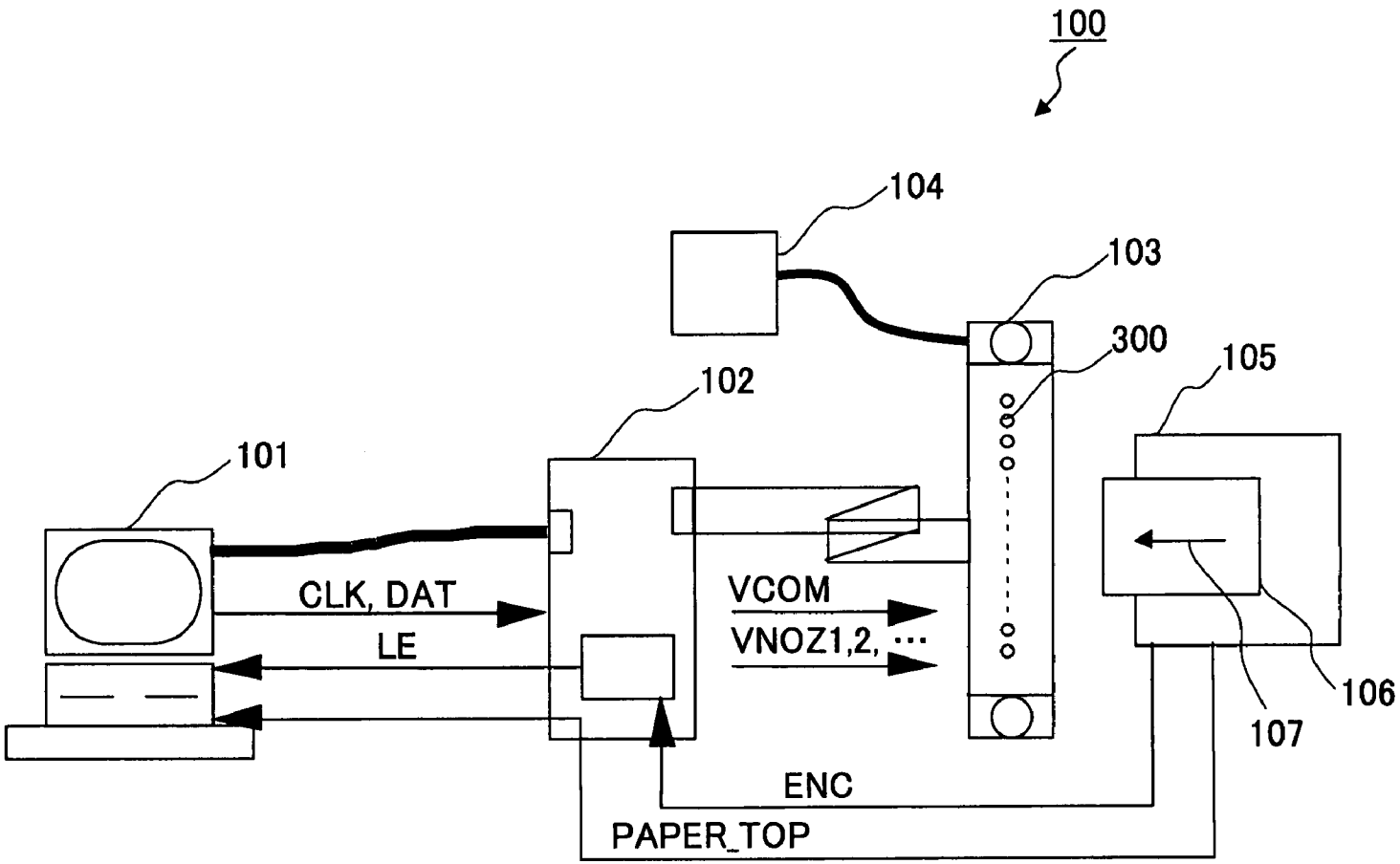
FIG. 1 is a diagram showing an example of an ink-jet printing device.

Embodiments of the present invention include an improved droplet ejection device and method in which the above-described problems are eliminated.

Other embodiment of the present invention include a droplet ejection device and a droplet ejection method which can adjust the ejection of ink with high precision and can suppress the occurrence of a jitter at the edge of the image, thereby raising the quality of image.

In order to achieve the above-mentioned embodiments, the present invention includes a droplet ejection device that includes at least one printing head module in which a plurality of nozzles are arranged, and ejects ink from the printing head module to a recording medium, the droplet ejection device comprising: a latch circuit acquiring discharge data in which a resolution is set up for each of resolution units in a transport direction of the recording medium, and setting discharge data elements in each resolution unit for respective ones of the plurality of nozzles; an output enable signal generating unit generating an output enable signal periodically at intervals of a distance differing from a distance of each resolution unit; a drive waveform applying unit applying a drive waveform to a common electrode line of respective piezoelectric elements of the plurality of nozzles in synchronization with the output enable signal, the drive waveform having a time to discharge each piezoelectric element gradually; and a switching circuit turning on or off a switch based on AND logic performing an AND of the output enable signal and the discharge data outputted from the latch circuit, and grounding an individual electrode of each of the piezoelectric elements of the plurality of nozzles.

In order to achieve the above-mentioned embodiments, the present invention includes a droplet ejection device that includes at least one printing head module in which a plurality of nozzles are arranged, and ejects ink from the printing head module to a recording medium, the droplet ejection device comprising: a latch circuit acquiring discharge data in which a resolution is set up for each of resolution units in a transport direction of the recording medium, and setting discharge data elements in each resolution unit for respective ones of the plurality of nozzles; an output enable signal generating unit generating an output enable signal periodically at intervals of a distance differing from a distance of each resolution unit, the output enable signal is shifted at a shift distance from a reference signal set up for each of a number of groups into which the plurality of nozzles are divided; a drive waveform applying unit applying a drive waveform to a common electrode line of respective piezoelectric elements of the plurality of nozzles in synchronization with the output enable signal; and a switching circuit turning on or off a switch based on results of AND logic ANDing the output enable signal and the discharge data outputted from the latch circuit, and grounding an individual electrode of each of the piezoelectric elements of the plurality of nozzles.

In order to achieve the above-mentioned embodiments, the present invention includes a droplet ejection method that uses at least one printing head module in which a plurality of nozzles are arranged, and ejects ink from the printing head module to a recording medium which is moved in a predetermined transport direction, the droplet ejection method comprising the steps of: acquiring discharge data in which a resolution is set up for each of resolution units in the predetermined transport direction of the recording medium to set discharge data elements in each resolution unit for respective ones of the plurality of nozzles; generating an output enable signal periodically at intervals of a distance differing from a distance of each resolution unit; applying a drive waveform to a common electrode line of respective piezoelectric elements of the plurality of nozzles in synchronization with the output enable signal, the drive waveform having a time to discharge each piezoelectric element gradually; and turning on or off a switch based on results of AND logic ANDing the output enable signal and the discharge data, to cause an individual electrode of each of the piezoelectric elements of the plurality of nozzles to be grounded.

In order to achieve the above-mentioned embodiments, the present invention includes a droplet ejection method that uses at least one printing head module in which a plurality of nozzles are arranged, and ejects ink from the printing head module to a recording medium which is moved in a predetermined transport direction, the droplet ejection method comprising the steps of: acquiring discharge data in which a resolution is set up for each of resolution units in a transport direction of the recording medium to set discharge data elements in each resolution unit for respective ones of the plurality of nozzles; generating an output enable signal periodically at intervals of a distance differing from a distance of each resolution unit, the output enable signal is shifted at a shift distance from a reference signal set up for each of a number of groups into which the plurality of nozzles are divided; applying a drive waveform to a common electrode line of respective piezoelectric elements of the plurality of nozzles in synchronization with the output enable signal; and turning on or off a switch based on AND logic ANDing the output enable signal and the discharge data, to cause an individual electrode of each of the piezoelectric elements of the plurality of nozzles to be grounded.

According to the droplet ejection device and method of the present invention, the ejection of ink (or the ink spread per unit area) can be adjusted with high precision and the occurrence of a jitter at the edge of the image can be suppressed, thereby raising the quality of image.

Although an ink-jet printing device will be explained as an example of a droplet ejection device, the droplet ejection device of this invention is not limited to the following example.

FIG. 1 shows an example of an ink-jet printing device. As shown in FIG. 1, this ink-jet printing device 100 is connected to a control unit 101, such as a PC (personal computer), and the ink-jet printing device 100 is constituted to include a drive circuit 102, an ink-jet printing head module 103, an ink tank 104, and a recording-medium transport device 105.

When the ink-jet printing device 100 starts printing to a recording medium, such as a substrate or paper, operation of the recording-medium transporting device 105 is started in accordance with a control signal outputted from the control unit 101. The recording-medium transporting device 105 transports a recording sheet 106 to the ink-jet printing head module 103 in a predetermined transport direction indicated by the arrow 107 (in FIG. 1, the transport direction is the left side from the right side). Suppose that the direction of the ink-jet printing head module 103 is a vertical direction in the figure, as shown in FIG. 1, and it is perpendicular to the sheet transport direction 107.

Upon starting of the recording-medium transporting device 105, the ink-jet printing device 100 generates a sheet position detection signal ENC by using an encoder provided in the recording-medium transporting device 105, for example, and transmits the signal ENC to the drive circuit 102.

By dividing the frequency of the received signal ENC, the drive circuit 102 generates a latch enabling signal LE which is a synchronizing signal for every line, and transmits the latch enabling signal LE to the control unit 101.

The control unit 101 receives the latch enabling signal LE from the drive circuit 102. Moreover, the control unit 101 starts a printing operation when a leading edge detection signal "PAPER_TOP" of the recording sheet 106 transmitted by an optical switch providing in the recording-medium transporting device 105 is received.

Specifically, the control unit 101 generates a data clock CLK and discharge data DAT which are synchronized with the latch enabling signal LE, and outputs the data clock CLK and the discharge data DAT to the drive circuit 102. The discharge data DAT are the serial data for every nozzle and they are transmitted in synchronization with the data clock CLK. In one embodiment, the value "1" of the discharge data denotes ejection of the ink droplet, and the value "0" of the discharge data denotes non-ejection.

Generally, according to the installed position of the ink-jet printing head module 103, the image data that are to be recorded are rearranged, and the resulting discharge data are output. The drive circuit 102 outputs a drive voltage VCOM common to all the plurality of nozzles, and individual drive voltages VNOZ1, 2, . . . of the respective nozzles, to the ink-jet printing head module 103.

The ink-jet printing head module 103 comprises the plurality of nozzles 300. Apart from the drive voltages VCOM and VNOZ mentioned above, the ink from the ink tank 104 is supplied to the ink-jet printing head module 103 via the pipe or the like.

Each of the plurality of nozzles 300 ejects the ink droplet to the recording sheet 106 according to the mechanism which will be described later. Thereby, a desired image is formed on the recording sheet 106 through the printing.

In order to explain clearly the difference between a normal drive circuit and a drive circuit of an embodiment of the invention, the composition and operation of the normal drive circuit will now be explained.

Example of Normal Drive Circuit

Figure 2:
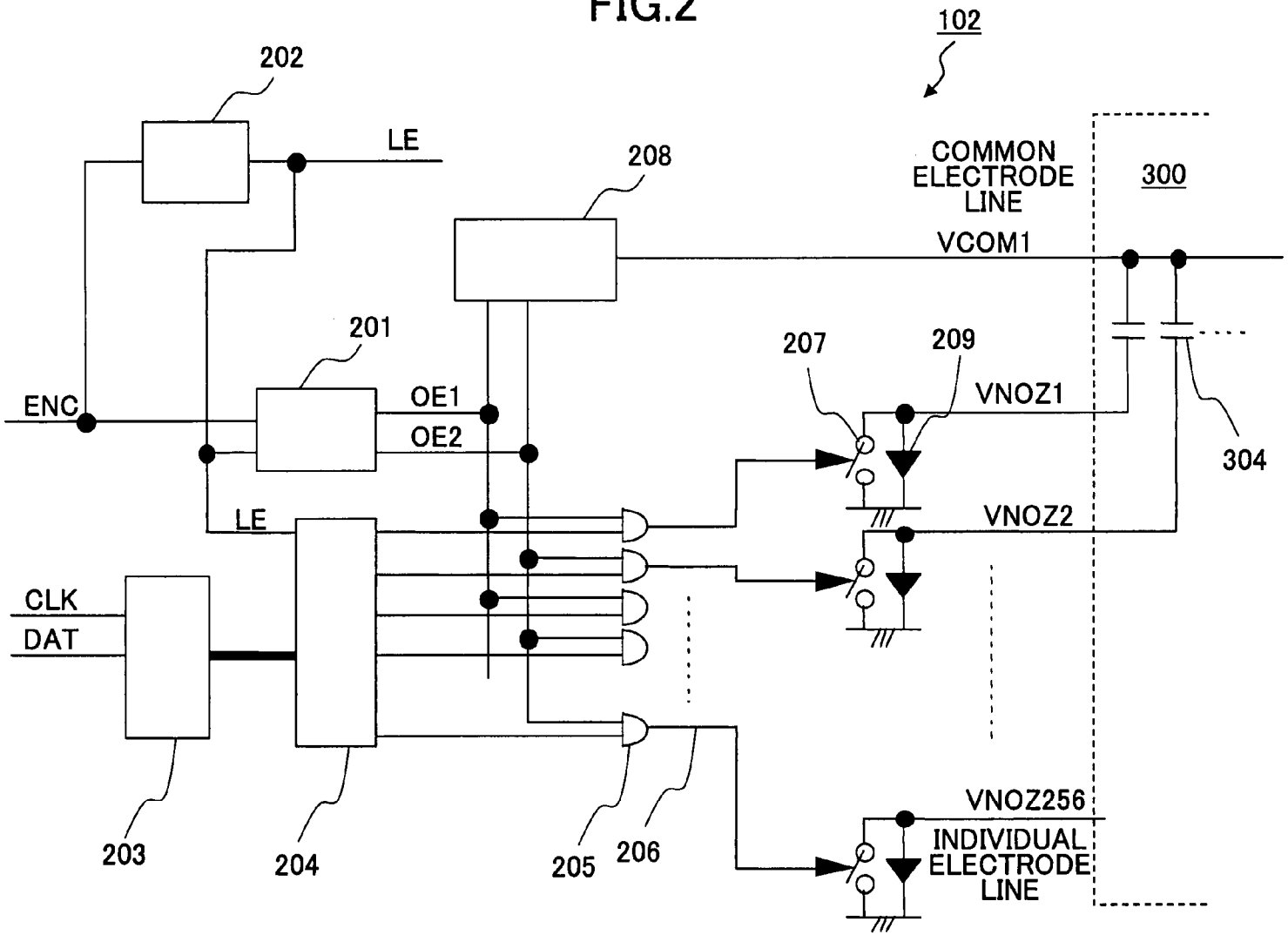
FIG. 2 is a diagram showing an example of a drive circuit.

FIG. 2 shows an example of the drive circuit. As shown in FIG. 2, the drive circuit 102 comprises an output enabling signal generating circuit 201, a latch enabling signal generating circuit 202, a shift register 203, a latch 204, an AND circuit 205, a switch pulse 206, a switch 207, a waveform generating unit 208, and a diode 209.

The latch enabling signal generating circuit 202 inputs a resolution in the transport direction 107 of the discharge data DAT for printing the predetermined image to the recording sheet 106 from the control unit 101 beforehand, and sets up the conditions for generating the latch enabling signal LE, based on the input resolution. In this example, the resolution is set to 600 dpi, for example. Therefore, the latch enabling signal generating circuit 202 divides the frequency of the sheet position detection signal ENC, and generates the latch enabling signal LE of 600 dpi which is a synchronizing signal for every line.

The paper position detection signal ENC in this example detects the position of the recording sheet 106 with the resolution of 0.5 micrometers.

In this example, the transport direction resolution of the discharge data DAT in the sheet transport direction is set to 600 dpi (dots/inch). Therefore, the latch enabling signal generating circuit 202 generates the latch enabling signal LE every time the recording sheets 106 is transported by 1/600 inches. Since the resolution of the sheet position detection signal ENC is 0.5 micrometers, the latch enabling signal generating circuit 202 divides the frequency of the signal ENC by 83 or 84 by using the counter provided in the latch enabling signal generating circuit 202. The latch enabling signal LE is generated as a pulse for every 42.5 micrometers or a pulse for every 42 micrometers.

The latch enabling signal generating circuit 202 is configured so that any of these pulses is generated suitably and alternately in order to avoid accumulation of an error.

The distance interval of the latch enabling signal LE is set to a line distance which is set up for each line, when the resolution of the discharge data DAT in the transport direction is not set to 600 dpi. If it is the resolution that is common to the printing, the latch enabling signal LE can be generated without an accumulated error from the sheet position detection signal ENC with the resolution of 0.5 micrometers through the known dividing method. Therefore, even if the explanation is limited to the case of 600 dpi resolution as mentioned above, the generality of this invention is not limited to such an embodiment.

Nozzle Structure

Next, the structure of the nozzles 300 that operate in accordance with the signal from the above-mentioned drive circuit will be explained. The nozzles 300 in the present example are essentially the same as the nozzles in the conventional device.

Figure 3:
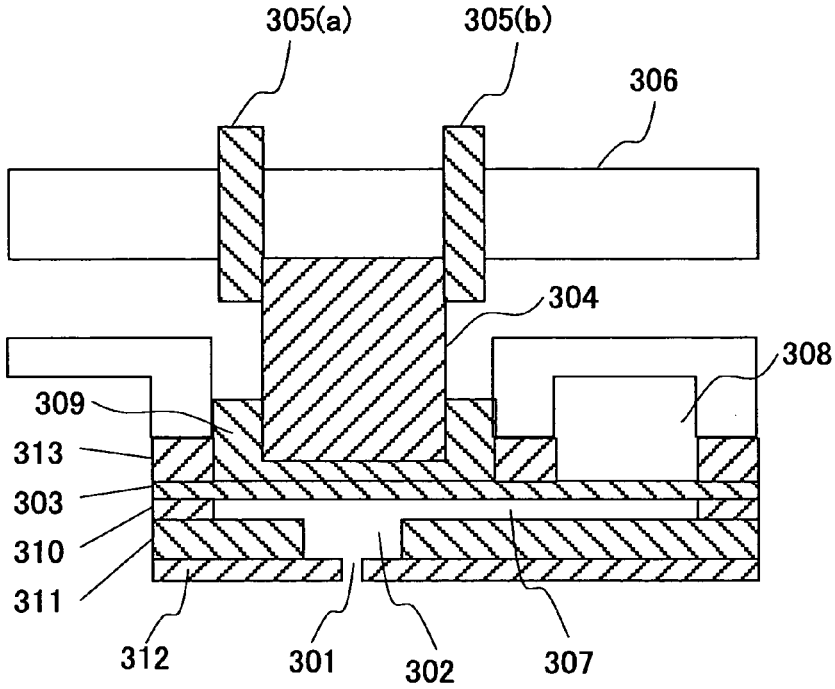
FIG. 3 is a diagram showing an example of the nozzle in this embodiment.

FIG. 3 shows an example of a nozzle 300. As shown in FIG. 3, the nozzle 300 comprises an orifice (nozzle hole) 301, a pressurizing chamber 302, a diaphragm 303, a piezoelectric element 304, a signal input terminal 305, a piezoelectric element fixing substrate 306, a restrictor 307, a common ink supply path 308, an elastic material 309, a restrictor plate 310, a pressurizing chamber plate 311, an orifice plate 312, and a support plate 313.

The restrictor 307 connects the common ink supply path 308 and the pressurizing chamber 302 control the ink flow rate to the pressurizing chamber 302. The elastic material 309 connects the diaphragm 303 and the piezoelectric element 304. For example, the elastic material 309 is made of a silicone adhesive or the like. The restrictor plate 310 is provided to form the restrictor 307. The pressurizing chamber plate 311 is provided to form the pressurizing chamber 302. The orifice plate 312 is provided to form the orifice 301. Moreover, the support plate 313 is provided to reinforce the diaphragm 303.

For example, the diaphragm 303, the restrictor plate 310, the pressurizing chamber plate 311, and the support plate 313 are made of a stainless steel material or the like. For example, the orifice plate 312 is made of a nickel material or the like. For example, the piezoelectric element fixing substrate 306 is made of an insulator, such as ceramics or a polyimide resin.

In the nozzle 300 of FIG. 3, the ink flows from the top to the bottom in order of the common ink supply path 308, the restrictor 307, the pressurizing chamber 302, and the orifice 301. The piezoelectric element 304 is arranged so that, when a voltage is applied to the signal input terminal 305, the piezoelectric element 304 expands and contracts, and when no voltage is applied to the signal input terminal 305, there is no deformation of the piezoelectric element 304. An analog driving signal which will be mentioned later is connected to the signal input terminal 305, and the voltage is applied according to the discharge timing, and the ink droplets in the pressurizing chamber 302 are partially ejected from the orifice 301.

As shown in FIG. 1, nozzles in the plurality of nozzles 300 each of which is shown FIG. 3 are arranged in one row in the ink-jet printing head module 103. In this example, the pitch of the nozzles 300 is set to 100 npi (nozzles/inch). In the actual ink-jet printing head module, six rows of the plurality of nozzles 300 are arranged in parallel and the resolution in the nozzle direction is set to 600 dpi. However, for the sake of convenience of description, the ink-jet printing head module of this example in which the nozzles are arranged in one row with the resolution of 600 npi will be explained.

Although the number of nozzles in this example is also set to 256 pieces as an example, the present invention is not limited to this example.

In the composition of FIG. 3, the signal input terminal 305(*a*) is connected at one end to all the plurality of nozzles 300 inside, and the drive voltage VCOM is applied to this signal input terminal 305(*a*). The signal input terminal 305(*b*) is connected individually to each of the plurality of nozzles 300, and one of the individual drive voltages VNOZ 1-256 is applied to this signal input terminal 305(*b*). Thus, the droplet ejection device of an embodiment of the present invention is characterized in that the driving of the plurality of nozzles is realized with a simple structure with the use of the signal input terminal 305(*a*) in common to all the plurality of nozzles 300 inside.

In the drive circuit 102 of FIG. 2, the discharge data DAT obtained from the control unit 101 are sequentially stored in the shift register 203 in synchronization with the data clock CLK, and are stored in the latch 204 collectively, when the data elements for 256 nozzles are acquired, in synchronization with latch enabling signal LE. On the other hand, the latch enabling signal LE is sent also to the output enable signal generating circuit 201.

Figure 4:
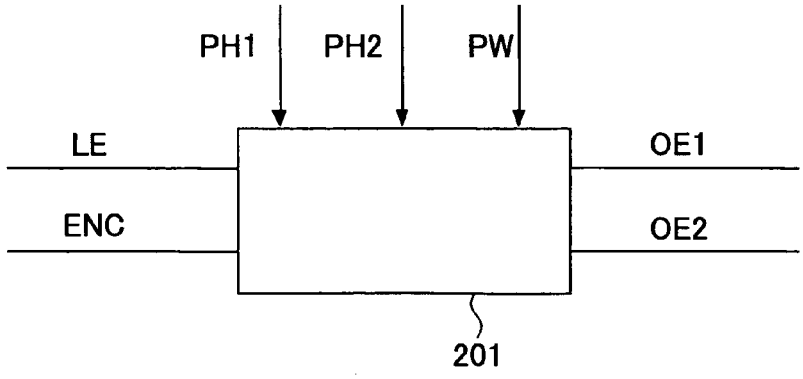
FIG. 4 is a diagram showing an example of an output enable signal generating circuit.

FIG. 4 shows an example of the output enable signal generating circuit. The output enabling signal generating circuit 211 inputs the latch enabling signal LE and the sheet position detection signal ENC, and outputs the output enabling signals OE1, . . . , OEn (n>=1). Each of the output enabling signals OE1, . . . , OEn is a trigger signal of generating the output enabling signal for the group of the number n of nozzles (which will be mentioned later) and the drive voltage waveform VNOZ to the plurality of nozzles. The waveform generating unit 208 detects the rising edge of this output enabling signal, and generates a drive waveform in synchronization with the detection.

In this example, as shown in FIG. 4, for the sake of convenience of description, the number of the output enabling signals OE is set to 2 (n=2), and the plurality of nozzles are divided into the odd-numbered nozzle group and the even-numbered nozzle group.

In the output enable signal generating circuit 201, the distance PH1 (micrometer) from the latch enabling signal LE to the rising edge of the output enabling signal OE1, the distance PH2 (micrometer) from the latch enabling signal LE to the rising edge of the output enabling signal OE2, and the common time pulse-width PW (microseconds) are predetermined by the control unit 101. Therefore, the output enable signal generating circuit 201 serves as a counter circuit which counts the sheet position detection signal ENC in synchronization with the latch enabling signal LE, generates the rising edge of the output pulse when the count value reaches both the predetermined distances PH1 and PH2, and generates the falling edge of the output pulse when the count value is forwarded by the common time pulse-width PW.

Next, the latch 204 outputs the stored discharge data DAT to the AND circuit 205 to which the output enabling signals OE1 and OE2 (in this example, n=2) are inputted. The output enabling signal OE1 is connected to the discharge data DAT of the odd-number group nozzles, and the output enabling signal OE2 is connected to the discharge data DAT of the even-number group nozzles. The resulting signal is outputted to the switch 207 corresponding to each of the plurality of nozzles.

One end (for example, the top side in FIG. 2) of each switch 207 is connected to one of the individual signal input terminals 305(*b*) corresponding to the nozzle 300, and the drive potential difference is set to the corresponding one of the drive voltages VNOZ1-VNOZ256. All the other ends (for example, the bottom side in FIG. 2) of the respective switches 207 are grounded. Moreover, the diode 209 is connected in parallel to each switch 207.

Therefore, when the output enabling signals OE1 and OE2 are '1', each switch 207 is turned on (closed) and the drive voltages VNOZ1-VNOZ256 are grounded. When the output enabling signals OE1 and OE2 are set to '0', each switch 207 is released (opened) and the drive voltages VNOZ1-VNOZ256 are set to free potential.

Although the common time pulse width PW for the output enabling signals OE1 and OE2 is predetermined as mentioned above, it is preset to be equivalent to the pulse width for the waveform time of the drive voltages VCOM. For this reason, the output enabling signals OE1 and OE2 are held '1' when the drive voltages VCOM are output, and each drive voltage VCOM is fully applied to the piezoelectric element.

Since the diode 209 forwards the current thereafter so that the drive voltages VNOZ1-VNOZ256 may not become a positive potential, the amount of the current by the natural electric discharge of the piezoelectric element can be supplied.

Next, the waveform generating unit 208 will be explained with reference to the drawings. The waveform generating unit 208 in this example is essentially the same as that in the conventional device.

Figure 5:
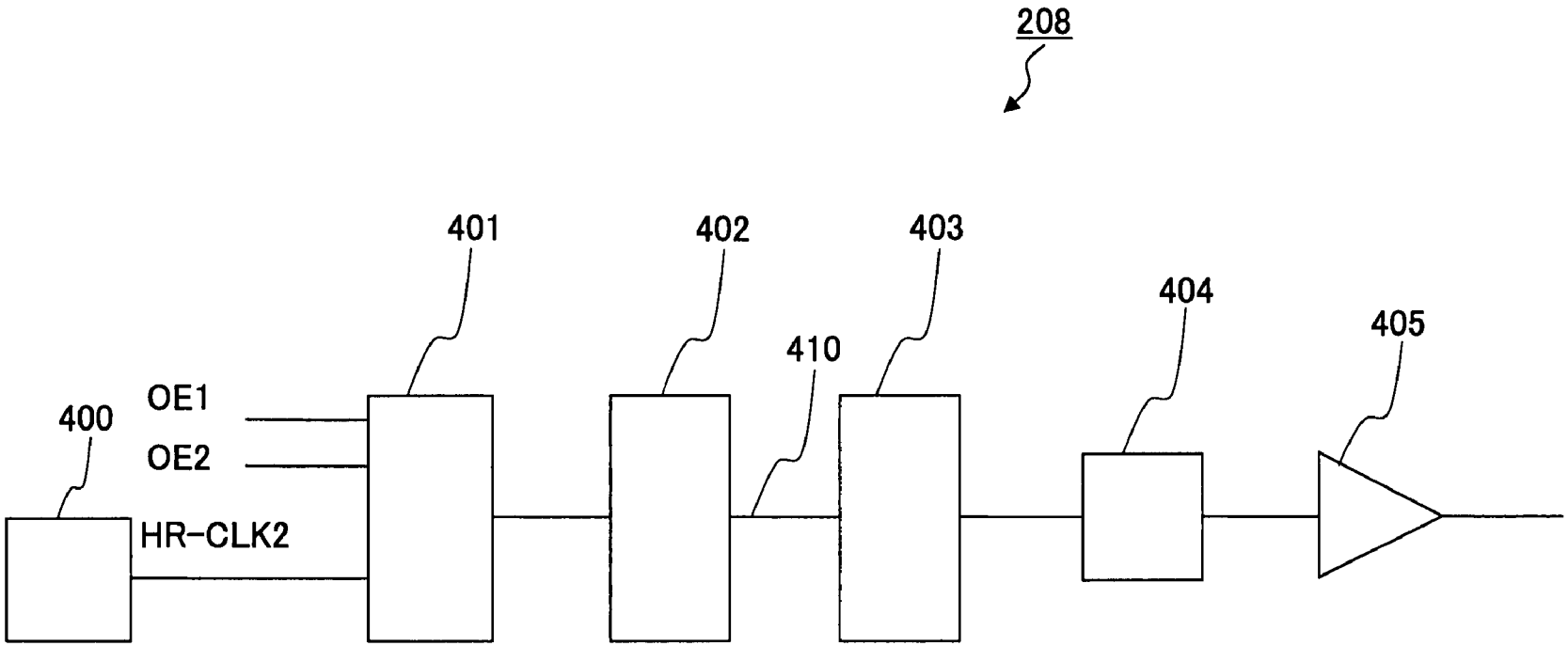
FIG. 5 is a diagram showing an example of a waveform generating unit.

FIG. 5 shows an example of the waveform generating unit. As shown in FIG. 5, the waveform generating unit 208 is constituted to comprise a high frequency clock outputting unit 400, a binary counter 401, a waveform memory 402, a digital-to-analog converter 403, an operational amplifier circuit 404, and an amplifier 405.

The binary counter 401 counts the high frequency clock HR-CLK2 from the high frequency clock outputting unit 400, and the count value is cleared in the rising edge of each of the output enabling signals OE1 and OE2. The binary counter 401 outputs its binary output to the waveform memory 402.

The waveform memory 402 outputs the stored output waveform data 410 to the digital analog converter 403. The digital-to-analog converter 403 creates an analog signal from the inputted digital data, and outputs the analog signal to the operational amplifier circuit 404.

The operational amplifier circuit 404 and the amplifier 405 amplify the analog signal to generate the drive voltage VCOM. The amplifier 405 applies the generated drive voltage VCOM to each of the signal input terminals 305(*a*) of the respective nozzles 300.

Although the time width of the drive voltage VCOM varies depending on the printing head, the ink, etc., it is usually set to be in a range from several microseconds to several ten microseconds. Therefore, the common time pulse width PW for the output enabling signals OE1 and OE2 is also predetermined in order to be in conformity with this case.

Figure 6:
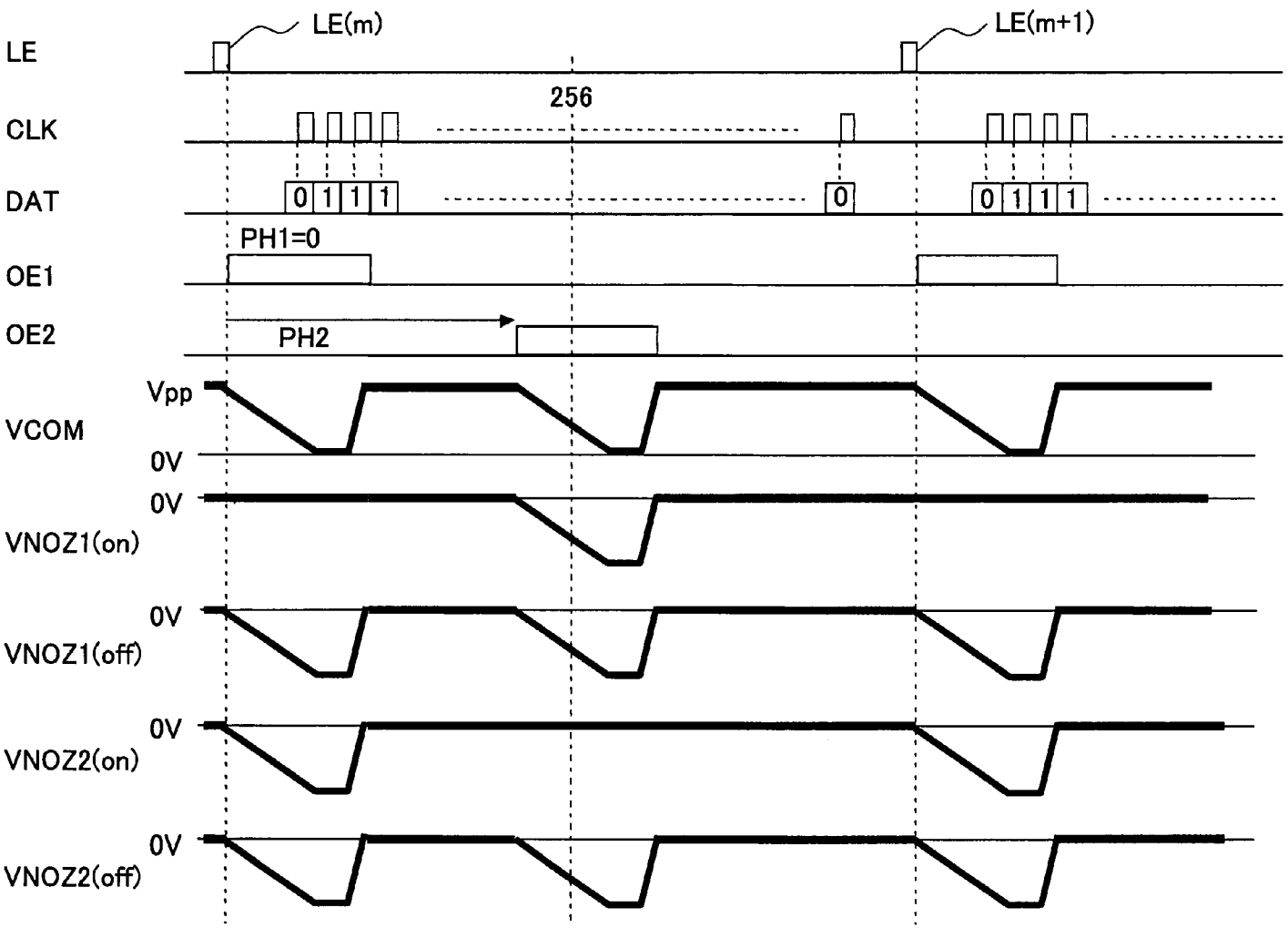
FIG. 6 is a timing diagram for illustrating the normal operation of the drive circuit.

FIG. 6 is a timing diagram for illustrating the normal operation of the drive circuit.

The discharge data DAT for the 256 nozzles and the data clock CLK that are obtained from the control unit 101 are transmitted between the time of the latch enabling signal LE (m) which indicates the m-th line synchronization (m>=1) and the time of the latch enabling signal LE (m+1) which indicates the m+1th line synchronization.

Usually, in the case of a high-speed multi-nozzle ink jet device, there is no time margin, and the discharge data DAT for the 256 nozzles and the data clock CLK are transmitted by using the whole time interval. In the case of this example, the latch enabling signal LE is generated at intervals of the cycle of 600 dpi (dots/inch), and this is equivalent to the period of the time 50 microseconds.

Since the period of the data clock CLK is 8 MHz, it takes 32 microseconds for transmitting the data DAT for the 256 nozzles.

The output enabling signal OE1 is turned into '1' in synchronization with the latch enabling signal LE which is set to '1' and the distance PH1 (in this example PH1=0 micrometers) is reached thereafter. The value '1' of the output enabling signal OE1 is held for the time width PW (in this example PW=10 microseconds) of the driving signal VCOM. Thereafter, the output enabling signal OE1 changes to '0'.

The output enabling signal OE2 is turned into '1' in synchronization with the latch enabling signal LE which is set to '1' and the distance PH2 (in this example, PH2=21 micrometers) is reached thereafter. The value '1' of the output enabling signal OE2 is held for the time width PW of the driving signal VCOM. Thereafter, the output enabling signal OE2 changes to '0'.

In synchronization with the rising edge of each of the output enabling signals OE1 and OE2, the waveform generating unit 208 generates the driving signal for the piezoelectric element, and applies the driving signal to the common electrode of the piezoelectric element as the drive voltage VCOM.

The waveform of the drive voltage VCOM is in the shape of an inverted trapezium as shown in FIG. 6, and the Vpp in FIG. 6 is set to be in a range of 30-40V, and the waveform time width (period) is set to 10 microseconds.

The drive voltage VNOZ1 applied to the individual electrode of each piezoelectric element of the odd-number group nozzles among all the individual electrodes of the piezoelectric elements is changed as in the waveform VNOZ1 (on) in FIG. 6 when the corresponding discharge data DAT is '1'. Namely, when the corresponding discharge data DAT is '1' and the output enabling signal OE1 is '1', the switch 207 is turned on (closed) and the drive voltage VNOZ1 is fixed to 0V. Since VNOZ3, VNOZ5, . . . can be explained similarly, the case of VNOZ1 represents the typical case. Thus, at this time, the drive voltage VCOM is applied to the piezoelectric element and the ink is ejected from the nozzle.

On the other hand, when the corresponding discharge data DAT is '0', the drive voltage VNOZ1 is changed as in the waveform VNOZ1 (off) in FIG. 6. Namely, at this time, the switch 207 is turned off (opened), the drive voltage VCOM is not applied to the piezoelectric element, and the ink is not ejected from the nozzle.

The drive voltage VNOZ2 applied to the individual electrode of each piezoelectric element of the even-number group nozzles among all the individual electrodes of the piezoelectric elements is changed as in the waveform VNOZ2 (on) in FIG. 6 when the corresponding discharge data DAT is '1'. Namely, when the corresponding discharge data DAT is '1' and the output enabling signal OE2 is '1', the switch 207 is turned on (closed) and the drive voltage VNOZ2 is fixed to 0V. Since VNOZ4, VNOZ6, . . . can be explained similarly, the case of VNOZ2 represents the typical case. Thus, at this time, the drive voltage VCOM is applied to the piezoelectric element and the ink is ejected from the nozzle.

On the other hand, when the corresponding discharge data DAT is '0', the drive voltage VNOZ2 is changed as in the waveform like VNOZ2 (off) in FIG. 6. Namely, at this time, the switch 207 is turned off (opened), the drive voltage VCOM is not applied to the piezoelectric element and the ink is not ejected from the nozzle.

Thus, the drive method shown in FIG. 6 is similar to the known 2-shift drive method, and simultaneous ejection of all the plurality of nozzles at the time of printing of a filled-in image can be avoided. The drive method shown in FIG. 6 is effective in reducing the electrical and mechanical cross talks.

As described above, the above-mentioned drive circuit is provided so that the generation of the output enabling signal OE is synchronized with the latch enabling signal LE. Namely, although the distance phases (PH1, PH2) differ in the output enabling signals OE1 and OE2, each of the output enabling signals OE1 and OE2 is generated once with respect to one clock of the latch enabling signal LE, respectively.

As for other drive methods, although the distance phase or the number of times of generation may differ, the feature that the output enabling signal OE is generated in synchronization with the latch enabling signal LE is common.

Figure 7A:
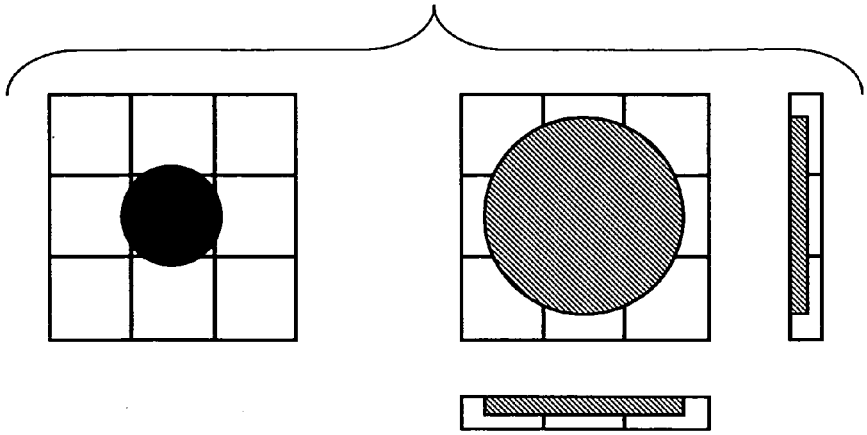
FIG. 7A, FIG. 7B and FIG. 7C are diagrams showing examples of fixing the ink droplet applied to the paper.
Figure 7B:
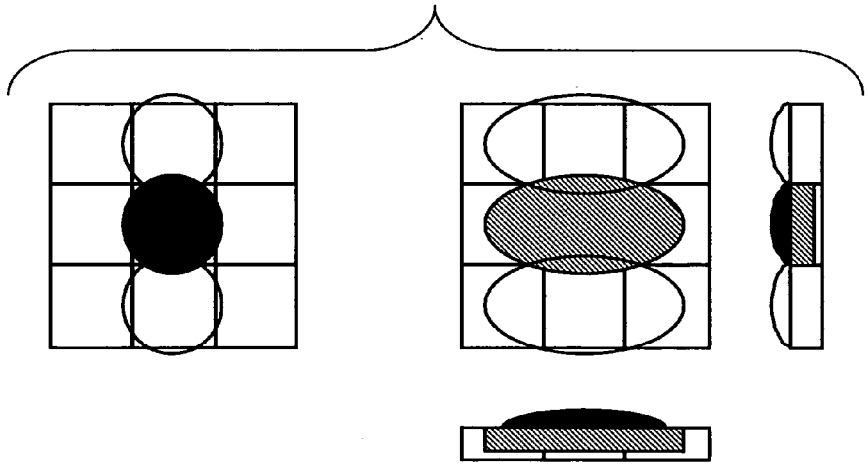
Figure 7C:
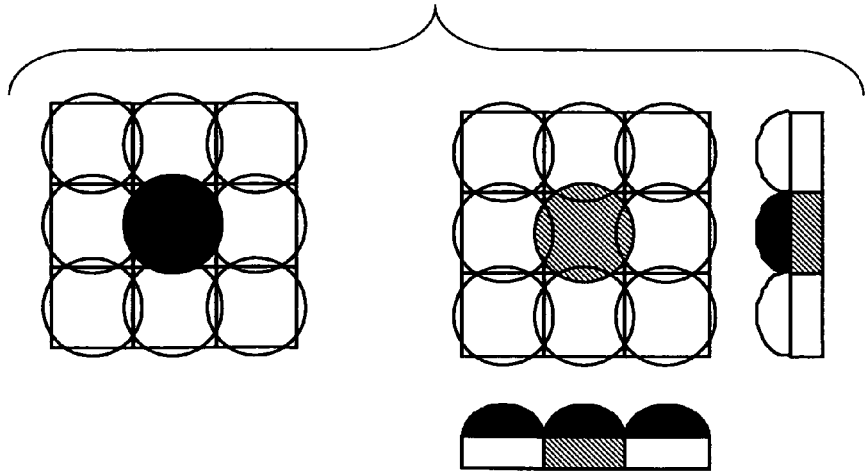

FIG. 7A, FIG. 7B and FIG. 7C show examples of the situation of fixing of the ink droplet applied to the paper. Suppose that the ink of a solvent or oil material with little evaporation (the boiling point is low) is used as the example in FIG. 7A-FIG. 7C.

Since the ink of this kind does not evaporate inside the nozzle, the ink has a high reliability to nozzle clogging. However, since the ink does not evaporate even on the paper, fixing of the ink to the paper is chiefly attained by permeation of the ink into the paper. In FIG. 7A-FIG. 7C, the left-hand side figure indicates the moment of ink droplet impact, and the right-hand side figure indicates the state of permeation of the ink into the recording sheet immediately after the impact of the ink droplet.

FIG. 7A shows the case in which one isolated dot is printed. In the case of FIG. 7A, since the ink permeates to the recording sheet while spreading greatly, all the ink immediately permeates to the recording sheet and it is fixed to the recording sheet.

FIG. 7B shows the case in which an isolated one-dot-width line is printed. In this case, since the ink cannot spread in the direction in which the line is connected, the area of the ink spreads little on the recording sheet. Then, the amount of permeation of the ink per unit area to the sheet becomes large, and a small amount of the ink which does not permeate remains on the surface of the sheet.

FIG. 7C shows the case in which a filled-in image area is printed. In this case, the ink cannot spread, and the ink permeates into the recording sheet as it is. There is a limit of the permeation of the ink, and a large amount of the ink that does not permeate to the surface of the recording sheet remains. In such a case, the non-fixed ink cannot be easily dried even when a heating unit, such as a drier, is used. Since the area of the ink does not spread in this case, the ink which does not go through the back surface of the recording sheet and it will be impossible to perform double-sided printing.

Thus, the ejection of the ink in an excessive amount that exceeds the necessary amount may cause the problem of printing to arise, and the ink is consumed unnecessarily.

To eliminate the problem, there are two methods. One method is to modulate the drive voltage applied to the piezoelectric element so that the size of ink droplet itself is made small. This method is ideal as a method of adjusting the amount of ink, but the circuit configuration becomes complicated. Thus, this method is not suitable as a controlling method of a high-speed multi-nozzle ink jet.

Figure 8:
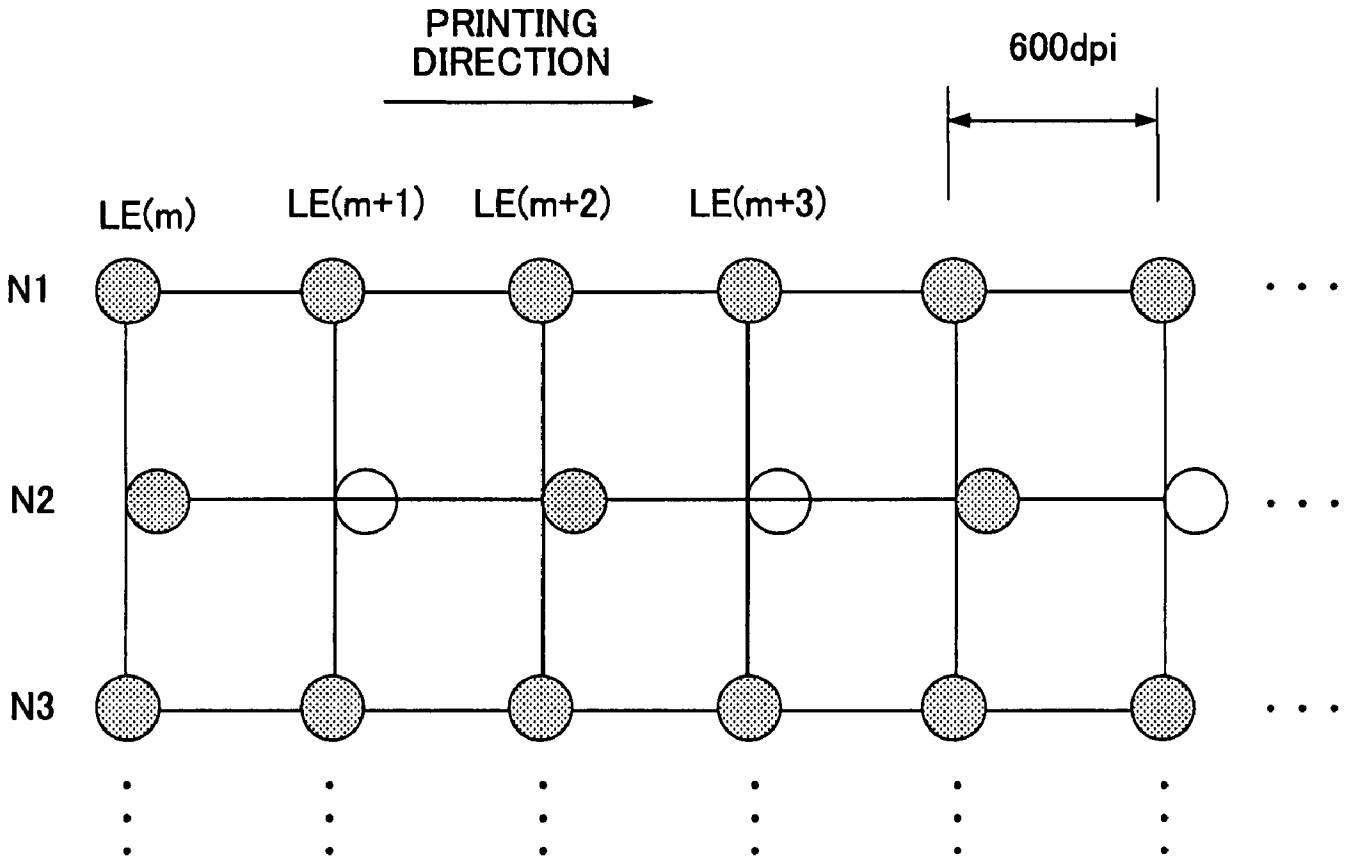
FIG. 8 is a diagram showing an example in which the amount of ink applied is adjusted by the method of skipping the discharge data.

The other method is to skip the discharge data so that the amount of ink applied is adjusted. FIG. 8 shows an example in which the amount of ink applied is adjusted by the method of skipping the discharge data. As shown in FIG. 8, the method of skipping the discharge data is similar to the half tone reproducing method, such as the known dithering method.

Specifically, the discharge timing (indicated by the shaded dot in FIG. 8) for the odd-numbered nozzles N1, N3, . . . is 600 dpi in the printing direction. The discharge timing (indicated by the shaded dot in FIG. 8) for the even-numbered nozzles N2, N4, . . . is 300 dpi in the printing direction. For this reason, in printing a filled-in image area, the amount of ink applied can be reduced to 75% to the image of 600 dpi. However, the resolution falls according to this method, but ununiformity of the optical density may occur and the quality of image may be degraded.

Also, there is a problem in that performing fine adjustment of the amount of ink applied between 100% and 75% is difficult. When the resolution of the base is as high as 1200 dpi or 2400 dpi, it is acceptable, but the high-resolution method is not appropriate as a controlling method of a high-speed multi-nozzle ink jet.

A description will now be given of an embodiment of the invention with reference to the accompanying drawings.

In the following, a description will be given of the method of adjusting the ink droplet ejection which is suitable as a controlling method of a high-speed multi-nozzle ink jet.

Examples of Drive Circuit of the Invention

Figure 9:
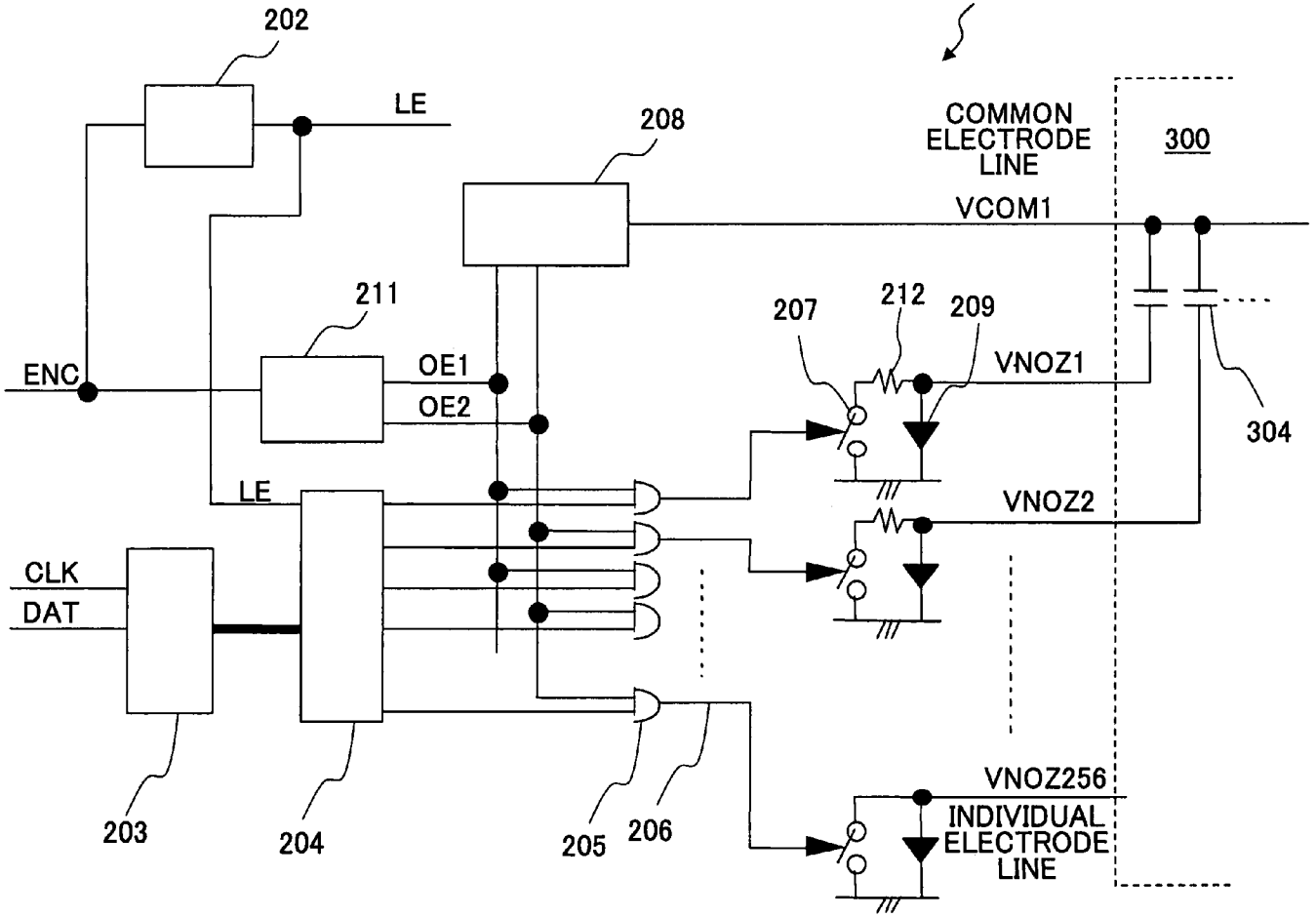
FIG. 9 is a diagram showing an example of a drive circuit in one embodiment of the invention.

FIG. 9 shows an example of a drive circuit in an embodiment of the invention.

In FIG. 9, the elements which are essentially the same as corresponding elements in FIG. 2 are designated by the same reference numerals, and a description thereof will be omitted.

Figure 10:
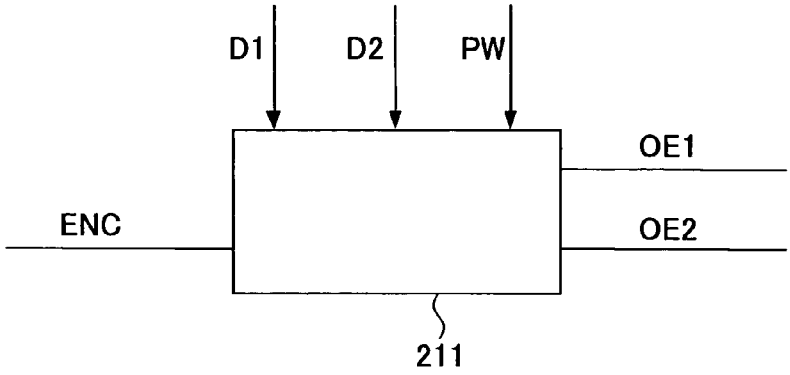
FIG. 10 is a diagram showing an example of the output enable signal generating circuit in the present embodiment.

FIG. 10 shows an example of the output enable signal generating circuit in the present embodiment.

Unlike the example shown in FIG. 4, the output enable signal generating circuit 211 in the present embodiment of the invention shown in FIG. 9 and FIG. 10 is configured to input only the sheet position detection signal ENC, and the latch enabling signal LE is not inputted to this output enable signal generating circuit 211.

Therefore, the parameters is set up beforehand by the control unit 101 are also different. Namely, in the control unit 101 of this embodiment, the distance interval D1 (micrometer) of the output enabling signals OE1 and OE2, and the shift distance D2 (micrometer) from the time of generation of OE1 to the time of generation of OE2 are predetermined, instead of the distance PH1 and PH2 in the previous example of FIG. 4. The common time pulse-width PW (microsecond) is predetermined in the same manner as in the example of FIG. 4. Thereby, generation of the output enabling signals OE1 and OE2 in the present embodiment is not synchronized with the latch enabling signal LE, and the present embodiment is not subjected to the influence by the resolution of the discharge data DAT in the transport direction at all. This feature of the invention is remarkably different from the example of FIG. 4.

The output enable signal generating circuit 211 in the present embodiment is provided so that it serves as a counter circuit which counts the sheet position detection signal ENC, and when the count value reaches each of the predetermined distance intervals D1 and D2, the counter circuit generates the rising edge of the output enabling signal.

The output enabling signal generating circuit 211 is provided so that is serves as a counter circuit which generates the falling edge of the output enabling signal when the time for the common time pulse-width PW is reached.

In the drive circuit shown in FIG. 9, the electric resistor 212 for restricting the current which flows into the switch 207 is provided in the switching circuit.

Figure 11:
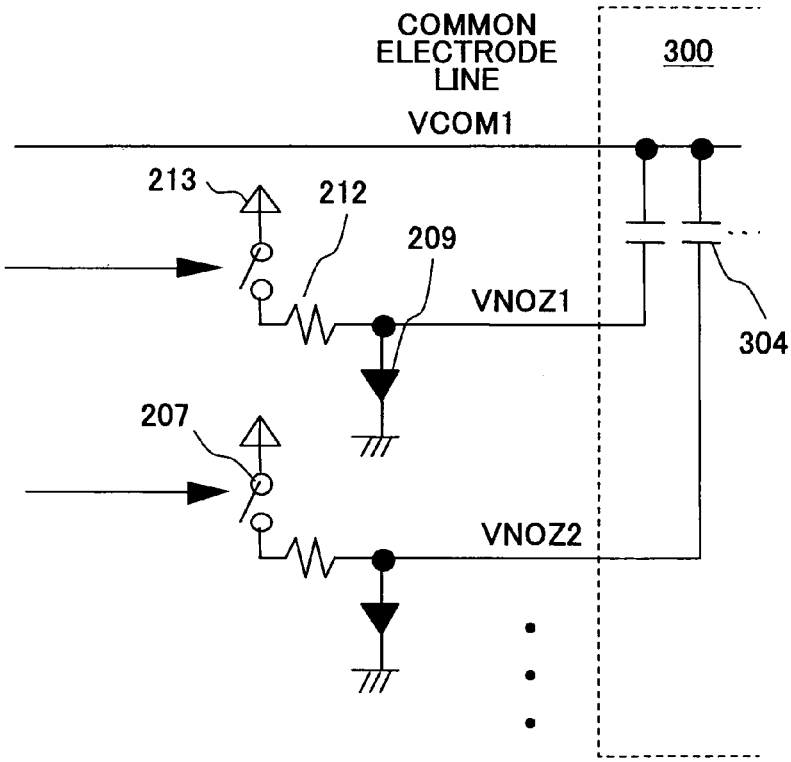
FIG. 11 is a diagram showing an example of the switching circuit of the drive circuit.

FIG. 11 shows an example of the switching circuit of the drive circuit. As shown in FIG. 11, the switching circuit is connected at one end to the power supply 213.

By using the composition of FIG. 11, the switching circuit can turn on or off the switch 207, and can set the discharge signal to be a positive potential. It is possible to realize a simplified circuit configuration. The above-mentioned electric resistor 212 will be described later.

Figure 12:
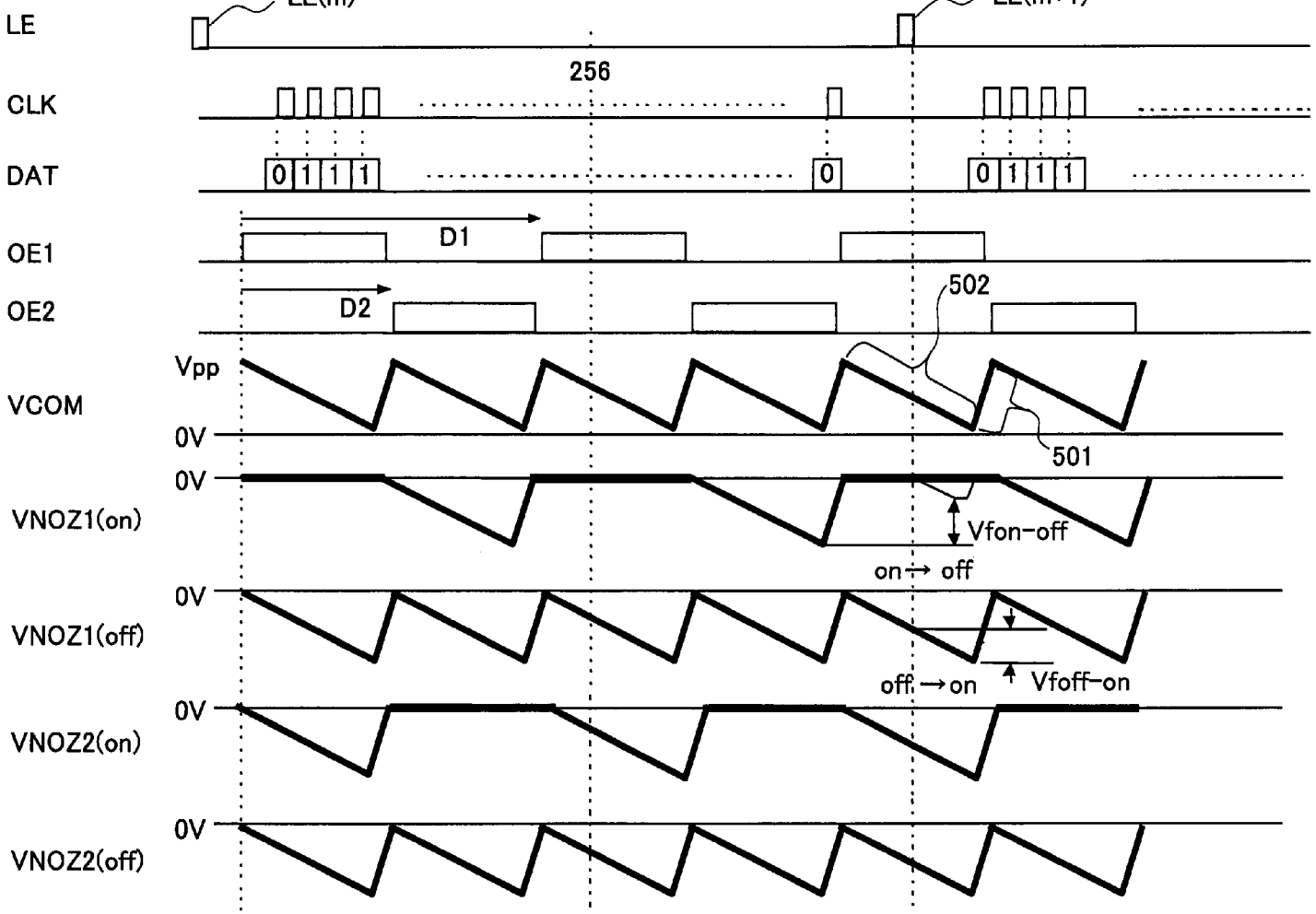
FIG. 12 is a timing diagram for illustrating the operation of the drive circuit of the present embodiment.

FIG. 12 is a timing diagram for illustrating the operation of the drive circuit of the present embodiment.

Unlike the operation of the above-mentioned drive circuit in FIG. 6, the drive waveform VCOM is generated in the drive circuit of this embodiment independently from the latch enabling signal LE as shown in FIG. 12.

It is usually necessary to generate the latch enabling signal LE in accordance with the resolution set for the data DAT to be transmitted as in the example of FIG. 6. For this reason, the latch enabling signal LE is generated at intervals of the predetermined distance (in this example, 600 dpi, i.e., about 42 micrometers).

In contrast, according to this embodiment, the drive waveform VCOM is generated based on the output enabling signals OE1 and OE2, and it is possible to freely set up the distance interval D1 to either 10 micrometers or 20 micrometers.

In this embodiment, as shown in FIG. 12, the encoder of 0.5-micrometer resolution is used, the setting of the distance interval D1 may be performed by the multiples of 0.5 micrometers, and the setting can be performed almost in a continuous manner. In the example shown in FIG. 12, the setting is made such that the distance interval D1=19 micrometers and the shift distance D2=9.5 micrometers. Therefore, the drive waveform VCOM is generated for every 9.5 micrometers.

The ejection timing of the ink for the odd-number nozzles is synchronized with the output enabling signal OE1, and the period is set to 19 micrometers. The ejection timing of the ink for the even-number nozzles is synchronized with the output enabling signal OE2, and the period is set to 19 micrometers. These timings are generated regardless of the period of the latch enabling signal LE.

The amount of ink applied per unit area is adjusted by changing the period (distance interval) D1 of the ejection timing of the ink. Specifically, when the period D1 is enlarged, the amount of ink applied decreases, and when the period D1 is shortened, the amount of ink applied increases.

Since the period D1 is not synchronized with the latch enabling signal LE which is generated according to the period corresponding to the resolution of the data DAT to be transmitted, it is possible to change the period D1 continuously.

The second difference is that while the drive waveform VCOM is generated, it is possible to update the discharge data DAT. In the example of FIG. 12, each of the waveform VCOM and the waveform VNOZ comprises an electric discharge waveform 502 which causes the piezoelectric element to discharge gradually by a predetermined time by using the drive waveform applying unit and makes the ink draw back, and a fire waveform 501 which charges the piezoelectric element rapidly in a time shorter than the predetermined time and causes the ink to be ejected. Therefore, the illustrated waveform VCOM or VNOZ is a sawtooth waveform.

The principle of generating the waveform VNOZ1 (on) shown in FIG. 12 is the same as that shown in FIG. 6. Namely, when the signal OE1 is at high level, the switch 207 is set to ON and it is grounded. As a result, the ink is ejected from the nozzles whose discharge data DAT is set to ON among the odd-number nozzles. When the signal OE1 is at low level, the switch 207 is turned off, the waveform VCOM is outputted as the waveform VNOZ1 without change, and the ink is not ejected from the nozzle.

The waveform VNOZ1 (on) of FIG. 12 shows the case in which the discharge data DAT is changed from on ('1') to off ('0') at the time (indicated by the vertical dotted line in FIG. 12) that the latch enabling signal LE (m+1) occurs. In this case, the switch 207 of FIG. 11 is opened and the electric discharge is stopped. At this time, the electric charge existing in piezoelectric element 304 remains. Ink ejection is contributed to a rapidly changing charging waveform.

In the usual case, the potential difference between VCOM and VNOZ at the time of the fire waveform 501 is set to Vpp. However, in this case, as shown in FIG. 12, because of the residual charge, the potential difference is decreased to the value of "Vfon−off" (or the value which is obtained by subtracting Vfoff from Vfon). Accordingly, the amount of ink ejection will be decreased. As a result, two ink droplets with the normal size and one ink droplet with a small size are ejected in the section between the signal LE (m) and the signal LE (m+1) preceding the next section.

The potential difference "Vfon−off" becomes smaller as the off time is longer among the on time and the off time of the electric discharge waveform 502 preceding the fire waveform 501. Thus, when the discharge data DAT is turned from the "on" state to the "off" state while the drive waveform VCOM is generated, an amount of ink droplet smaller than the usual amount is ejected according to the ratio of the off time to the on time. Therefore, the change of the discharge data is smoothed and the occurrence of redundant noises, such as moirés, can be prevented.

The waveform VNOZ1 (off) of FIG. 12 shows the case in which while the drive waveform VCOM is generated, the discharge data DAT is changed from the on state ('0') to the off state ('1') by the latch enabling signal LE (m+1).

If it changes in this way, the switch 207 shown in FIG. 9 is turned on (closed), and electric discharge is started suddenly. However, the current is restricted by the electric resistor 212 of FIG. 9, within the time of the electric discharge waveform 502, the ink ejection does not occur immediately.

In one embodiment, the electric resistor 212 has a suitable resistance so that the value of the current restricted by the electric resistor 212 and the value of the current discharged by the electric discharge waveform are substantially equal to each other. As shown in FIG. 12, the potential of VNOZ is maintained at the potential in the vicinity of the potential (which is called Vfoff−on) at which the switch is turned on (closed). Namely, the drive waveform VCOM in this embodiment is configured so that the fire waveform 501 is present immediately after the electric discharge waveform 502. Accordingly, the potential difference between VCOM and VNOZ is decreased to "Vfon−off" at the time of the fire waveform 501. Thereby, the ink ejection will be decreased.

The potential difference "Vfon−off" becomes smaller as the off time is longer among the on time and the off time of the electric discharge waveform 502 preceding the fire waveform 501. Thus, when the discharge data DAT is turned from the "off" state to the "on" state while the drive waveform VCOM is generated, an amount of ink droplet smaller than the usual amount is ejected according to the ratio of the off time to the on time. Therefore, the change of the discharge data is smoothed and the occurrence of redundant noises, such as moirés, can be prevented.

The same discussion may be applied for the cases of the waveforms VNOZ2 (on) and VNOZ2 (off). However, in this case, the ink ejection does not occur at the time (indicated by the vertical dotted line in FIG. 12) that the latch enabling signal LE (m+1) occurs, and reduction of the amount of ink ejection does not occur.

As mentioned above, according to this embodiment, the period of the drive waveform VCOM can be adjusted almost arbitrarily regardless of the resolution of the discharge data DAT in the transport direction (or regardless of the transmission of the discharge data DAT). The droplet ejection device and method of this embodiment is effective in the capability to eject a desired amount of ink to the recording medium, without degrading the quality of image.

In the above-mentioned embodiment, the number N of the nozzle groups is set as N=2. However, it is possible to set up the distance interval D1-I (where I denotes a number corresponding to a nozzle group) according to the number of nozzle groups, if the waveform time pulse-width PW of the drive waveform VCOM is small, the sheet transport speed is small, and the time for the distance interval D1 is large enough. In this case, the shift distance D2 is not set up. It is also possible to fix the distance interval D1 to the same value for all the nozzle groups, and set up the shift distance D2-I (where I denotes a number corresponding to a nozzle group) according to the number of nozzle groups. Even in such a case, this embodiment can be applied and it is possible to optimize the drive method for every nozzle group.

First Example of Setting of Ink Application Position

A description will be given of some examples of setting of ink application position in the above-mentioned embodiment.

Figure 13A:
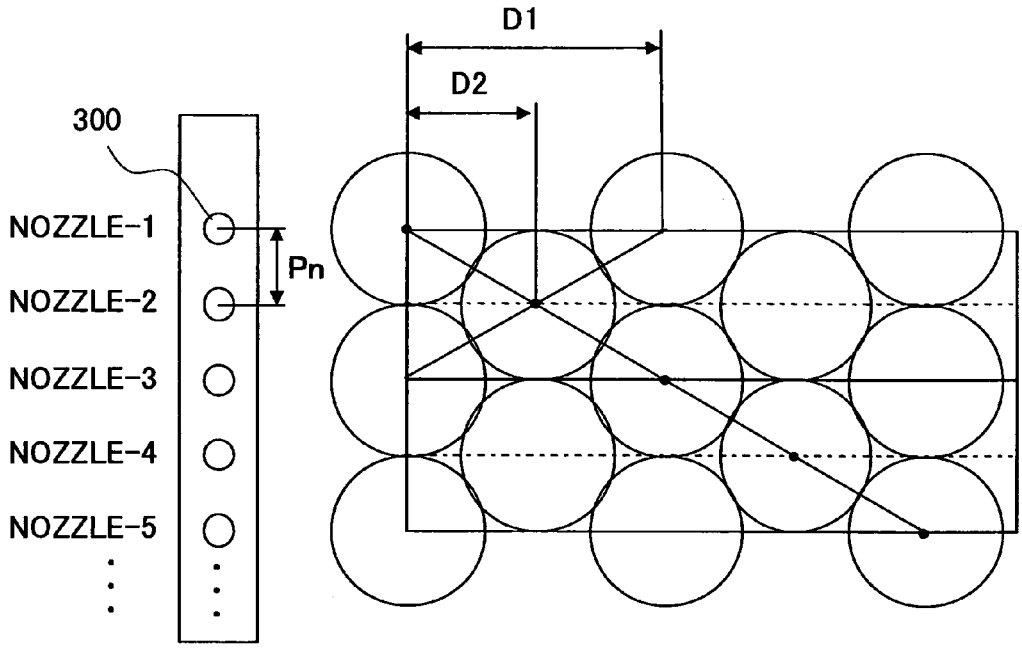
FIG. 13A and FIG. 13B are diagrams showing a first example of setting of ink application position in the present embodiment.
Figure 13B:
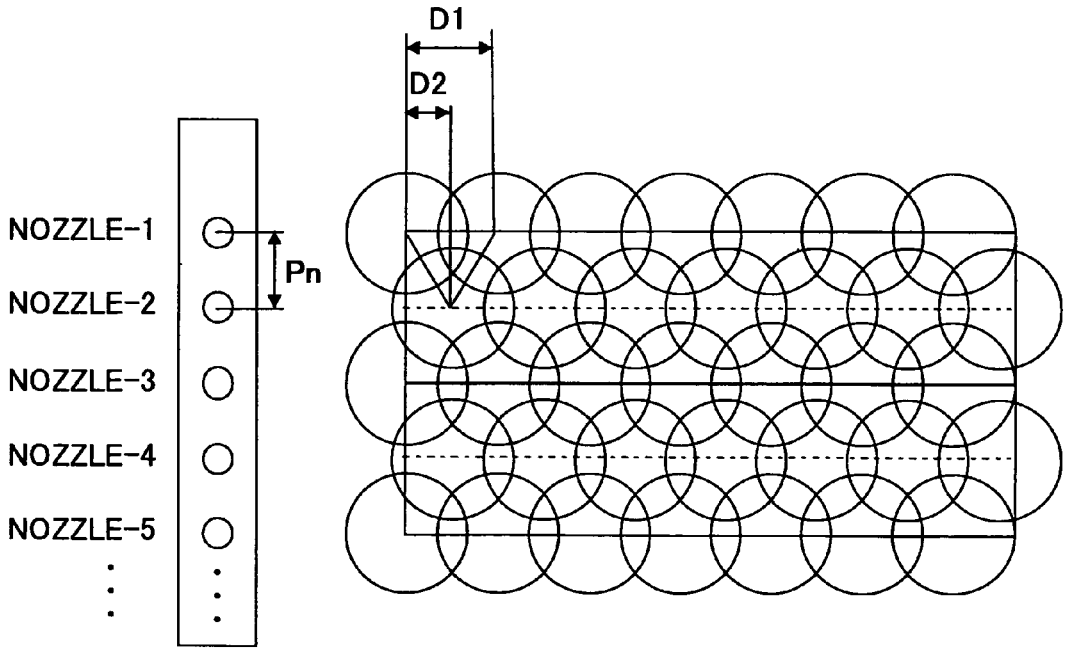

FIG. 13A and FIG. 13B show the first example of setting of the ink application position in this embodiment.

In the setting of FIG. 13A, the pitch Pn of the nozzles 300 is set to 1/600 inches (about 42.3 micrometers), the distance interval D1 is set to be in the vicinity of $2\sqrt{3}\times Pn$ (about 147 micrometers), and the shift distance D2 is set to be in the vicinity of $\sqrt{3}\times Pn$ (about 73.5 micrometers). Thereby, the result of printing to the recording medium by the ink application can be made in a minute lattice formation as shown in FIG. 13A.

Similarly, in the setting of FIG. 13B, the distance interval D1 is set to be in the vicinity of $2\times Pn/\sqrt{3}$ (about 49 micrometers) and the shift distance D2 is set to be in the vicinity of $Pn/\sqrt{3}$ (about 24.5 micrometers). The result of printing to the recording medium by the ink application can be made in a minute lattice formation as shown in FIG. 13B.

In the first example of setting, the ink application position is adjusted and the ink ejection amount is adjusted as mentioned above. If the ink droplet is in the shape of a sphere, the ink can be applied uniformly on the recording sheet. Also, a reproduced image without image defects, such as a white muscle, can be obtained with the minimum amount of ink per unit area.

Second Example of Setting of Ink Application Position

Next, another example of setting of ink application position in the above-mentioned embodiment will be explained.

Figure 14:
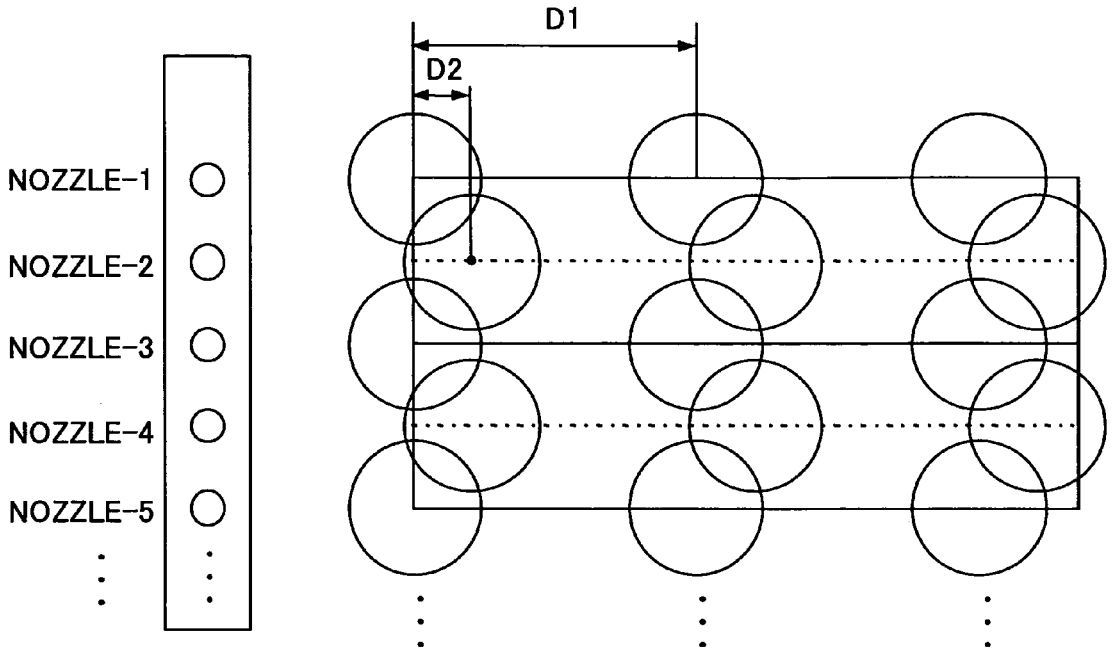
FIG. 14 is a diagram showing a second example of setting of ink application position in the present embodiment.

FIG. 14 shows the second example of setting of ink application position in the present embodiment.

In the setting shown in FIG. 14, suppose that the distance interval of the output enable signals OE1 and OE2 is set to D1

(micrometer), and the shift distance from the time of generation of the output enable signal OE1 used as a reference to the time of generation of the output enable signal OE2 is set to D2 (micrometer). And the shift distance D2 is adjusted so that the ink application position on the recording sheet 106 when printing is performed is set up.

Namely, when the ratio D2/D1 (the value which is obtained by dividing the shift distance D2 by the distance interval D1) is in the vicinity of the value ½, the permeation of the ink will be as shown in FIG. 7A.

When the ratio D2/D1 is in the vicinity of the value 0 or 1 (or when D2/D1 and (1−D2/D1) are in the vicinity of the value 0), the permeation of the ink will be as shown in FIG. 7B.

Thus, in the above-mentioned two cases, the way of permeation of the ink to the recording sheet 106 differs, and the quality of the ink image on the surface of the sheet 106 differs.

Therefore, by adjusting the value of D2/D1 according to this embodiment, it is possible that a recorded image is made to spread in a wide area and allows quick drying of the ink on the surface of the sheet.

The permeation of the ink to the back surface of the recording sheet can be prevented, and this can be attained by setting up the ratio D2/D1 to be near ½ when performing double-sided printing. When the optical density of image is raised and blotting of the ink is suppressed, or when the edge part of a line image in every direction is made sharp to raise the quality of image, the ratio D2/D1 should be set in the vicinity of the value 0 or 1.

Thus, the above-mentioned features of the present invention can be made efficient by selecting beforehand any of the setting of ink application position mentioned above, and setting them up before printing to the recording sheet.

As mentioned above, according to one embodiment of the present invention, the ejection of ink (or the ink spread per unit area) can be adjusted with high precision. The occurrence of a jitter at the edge of the image can be suppressed. Thereby, it is possible to raise the quality of a printed image. While the problems, such as ink dryness and permeation of ink to the back surface of the sheet are eliminated, the quality of a printed image can be finely adjusted, and total optimization is attained.

Since the discharge of half tone image is possible according to the ratio, degradation factors to the quality of image, such as moirés formed on the boundary of data, can be eliminated and a high precision image can be formed.

The present invention is not limited to the above-described embodiments, and variations and modifications may be made without departing from the scope of the present invention.

What is claimed is:

1. A droplet ejection device that includes at least one printing head module in which a plurality of nozzles are arranged, and ejects ink from the printing head module to a recording medium, comprising:

a latch circuit configured to acquire for each of a plurality of resolution sections a discharge data that defines a resolution in a transport direction of the recording medium to set discharge data elements for respective ones of the plurality of nozzles with respect to each of the plurality of resolution sections;

an output enable signal generating unit configured to output an output enable signal periodically at intervals of a period differing from an integral multiple of a period between two of the plurality of resolution sections;

a drive waveform applying unit configured to apply a drive waveform to a common electrode line of respective piezoelectric elements of the plurality of nozzles in synchronization with the output enable signal from the output enable signal generating unit, the drive waveform having a time to discharge each piezoelectric element gradually; and a switching circuit configured to turn on or off a switch based on results of ANDing the output enable signal from the output enable signal generating unit and the discharge data from the latch circuit to cause an individual electrode of each of the piezoelectric elements of the plurality of nozzles to be grounded, wherein the period of the output enable signal from the output enable signal generating unit is controlled to adjust an amount of the ink ejected.

2. The droplet ejection device according to claim 1 wherein the drive waveform applying unit generates the drive waveform, where the drive waveform comprises an electric discharge waveform that makes each piezoelectric element discharge gradually by a predetermined time and makes the ink draw back, and a fire waveform that charges each piezoelectric element in a time shorter than the predetermined time and makes the ink eject.

3. The droplet ejection device according to claim 2 wherein the switching circuit comprises:

an electric resistor connected to the switch in series to restrict a discharge current when the switch is turned on during the electric discharge waveform; and a diode to connect, during the fire waveform, the individual electrode to a grounded side, to forward current without receiving restriction of the electric resistor.

4. The droplet ejection device according to claim 3 wherein a value of the discharge current restricted by the electric resistor and a value of the current discharged by the electric discharge waveform are substantially equal.

5. The droplet ejection device according to claim 1 wherein the plurality of nozzles are divided into a group of odd-numbered nozzles and a group of even-numbered nozzles, and the output enable signal generating unit is operable to generate a first output enable signal corresponding to a case in which a ratio (D2/D1) of a shift period D2 to a period D1, where D1 denotes a period of ejection timing and D2 denotes a shift period of the period D1, is set to be approximately equal to the value ½, and a second output enable signal corresponding to a case in which (D2/D1) or (1−D2/D1) is set to be approximately equal to the value zero.

6. The droplet ejection device according to claim 1 wherein the output enable signal generating unit is operable to generate either an output enable signal in which a period D1 is set to $2\sqrt{3}\times Pn$ and a shift period D2 is set to $\sqrt{3}\times Pn$, where D1 denotes a period of ejection timing, D2 denotes a shift period of the period D1, and Pn denotes a nozzle pitch, or an output enable signal in which the period D1 is set to $2\ Pn/\sqrt{3}$ and the shift period D2 is set to $Pn/\sqrt{3}$.

7. The droplet ejection device according to claim 1 wherein the printing head module is an ink-jet printing head module.

* * * * *

UNITED STATES PATENT AND TRADEMARK OFFICE

CERTIFICATE OF CORRECTION

PATENT NO. : 7,604,311 B2
APPLICATION NO. : 11/361541
DATED : October 20, 2009
INVENTOR(S) : Kobayashi et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 359 days.

Signed and Sealed this

Fifth Day of October, 2010

David J. Kappos

David J. Kappos
*Director of the United States Patent and Trademark Office*